United States Patent [19]

Vann

[11] 4,140,188

[45] Feb. 20, 1979

[54] HIGH DENSITY JET PERFORATING CASING GUN

[75] Inventor: Roy R. Vann, Odessa, Tex.

[73] Assignee: Peadby Vann, Houston, Tex.

[21] Appl. No.: 842,567

[22] Filed: Oct. 17, 1977

[51] Int. Cl.[2] ..... E21B 43/116

[52] U.S. Cl. ..... 175/4.51; 175/4.55; 175/4.6; 166/63

[58] Field of Search ..... 175/4.51–4.6; 166/63

[56] References Cited

U.S. PATENT DOCUMENTS

| | | | |
|---|---|---|---|
| 2,821,136 | 1/1958 | Castel | 175/4.55 |
| 2,873,676 | 2/1959 | Caldwell | 175/4.6 |
| 3,565,188 | 2/1971 | Hakala | 175/4.6 |

*Primary Examiner*—Ernest R. Purser
*Assistant Examiner*—Nick A. Nichols, Jr.
*Attorney, Agent, or Firm*—Marcus L. Bates

[57] ABSTRACT

A high density perforating gun having series connected multiple gun housings within which a plurality of jet perforating shaped charges are arranged in spaced apart clusters. The charges of each cluster are captured in radially spaced apart symmetrical relationship within a mounting assembly, and each housing includes a plurality of the mounting assemblies which are spaced vertically apart from one another. The charges contained within each mounting assembly are orientated respective to the charges of the remaining mounting assemblies so that any charge located in one mounting assembly is spaced apart both radially and vertically from the nearest adjacent charge of an adjacent mounting assembly. This arrangement permits a maximum number of shaped charges to be placed within a finite volume. All of the charges contained within one housing are simultaneously detonated. The explosive force resulting from a plurality of shaped charges arranged in the above high density manner brings about the unexpected benefit of a more desirable and predetermined perforating pattern distribution as well as achieving deeper penetration into the pay zone while at the same time avoiding misfire of the individual shaped charges.

11 Claims, 7 Drawing Figures

HIGH DENSITY JET PERFORATING CASING GUN

BACKGROUND OF THE INVENTION

It is often desirable to run a casing jet perforating gun downhole and to perforate a casing with a very close distribution of perforations. In the past, this has been achieved by running a select fire gun downhole and repositioning the gun between each shot and consequently, the distribution pattern of the shaped charges is speculative for the reason that the exact orientation of the gun between shots is unknown and therefore, it is possible to place all of the perforations through the same hole formed in the casing, and of course, this is a very undesirable perforating job. Moreover, it is possible to inadvertently space the shots in a pattern which damages the casing or which causes jagged edges thereof to be formed which presents difficulty in subsequently running tool strings downhole.

Others have resorted to using a jet perforating gun having single charges spaced apart from one another on a very wide spacing and by making several expensive trips into the hole so that the resultant number of desired perforations can be achieved, however, here again the distribution of the shots is questionable for the obvious reason that orientation of the gun and the slight difference in elevation between trips inherently provides a large margin of error.

It would be desirable to be able to arrange a plurality of shaped charges within a perforating gun in such a manner that a high density pattern of symmetrical perforations may be achieved in a single firing of the gun with as many as 12-20 perforations per foot being realized. Such a desirable expedient would provide a perforated casing with a definite distribution pattern which has heretofore been unavailable. Such a desirable expedient is the subject of this invention.

SUMMARY OF THE INVENTION

A perforating gun device for perforating a casing with a high density distribution of shots arranged in a specific symmetrical pattern. The apparatus includes a gun housing within which a plurality of shaped charges are formed into a cluster, and a plurality of clusters are incorporated into each of the housings with the clusters being spaced apart from one another both vertically and radially to achieve a high density symmetrical perforating pattern comprised of 12–20 shots per foot.

The clusters of shaped charges include a mounting assembly for recieving each individual shaped charge is captured relationship therewithin, with the charges of a cluster being radially arranged respective to one another and disposed with the detonating end of the charge in close proximity to the longitudinal axial centerline of the housing.

A detonating means extends through the axial centerline of the perforating gun device and into contact with each of the charges of each of the clusters so that when the detonating means is actuated, all of the shaped charges are substantially, simultaneously exploded.

Simultaneous explosion of all of the shaped charges provides equal and opposite forces which tend to avoid misalignment of the charges during the exceedingly short time span required for complete detonation of all of the shaped charges.

In one form of the invention, multiply housings spaced from one another constitute the gun device, and the charge containing housing to be detonated can be selected in a manner to enable any firing sequence of the charges located within the various different housings to be selected after the gun device has been run downhole.

Accordingly, a primary object of this invention is the provision of a multiple charge carrier gun having clusters of shaped charges contained therewithin which are simultaneously fired to perforate a casing with a high density distribution of perforations.

A further object of the present invention is the provision of improvements in casing perforating gun devices, which enables an exceedingly thick pay zone to be perforated in all directions in a single trip.

Another object of the invention is the provision of a casing jet gun device having the charges arranged therewithin in such a manner that 12–20 shots per foot of a predetermined symmetrical distribution pattern is achieved.

A still further object of this invention is the provision of a perforating gun device having a plurality of shaped charges arranged in vertically spaced apart clusters with the charges of a cluster being evenly distributed radially about the longitudinal axial centerline of the gun housing so that when the gun is fired, equal and opposite forces result.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
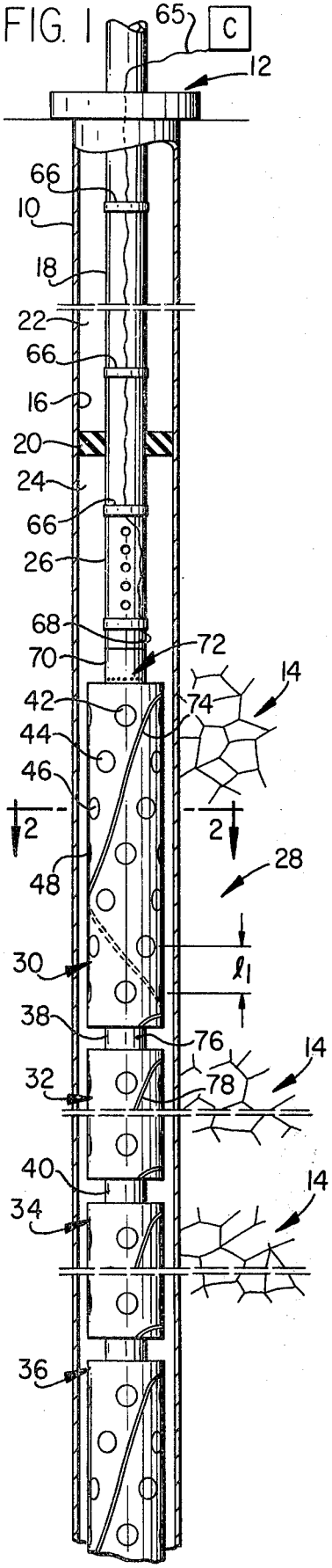
FIG. 1 is a part diagrammatical, part schematical representation of a cross-section of a wellbore having apparatus made in accordance with the present invention located downwhole therein.

In FIG. 1 a cased wellbore 10 extends from a Christmas tree 12 down through a production zone 14. The inside casing wall is indicated by numeral 16 while a tubing string 18 has a packer 20 attached thereto which packs off upper annulus 22 from a lower annulus 24.

A vent string 26 is connected to the lower end of the tubing string while a string of guns 28 are connected to the lower end of the vent assembly. The gun string comprising an uppermost perforating gun device 30 series connected to other gun devices 32, 34, and 36 which are identical to the uppermost gun device 30. Connector subs 38 and 40 interconnect each of the gun devices so that one is supported from the other. A series of port plugs 42 lie in clusters along a horizontal plane and the ports of a cluster circumferentially extend about the housing and are radially spaced from one another. Another series of port plugs 44, 46 and 48 are likewise disposed in a horizontal plane in spaced relationship to one another and extend circumferentially about the gun.

Figure 2:
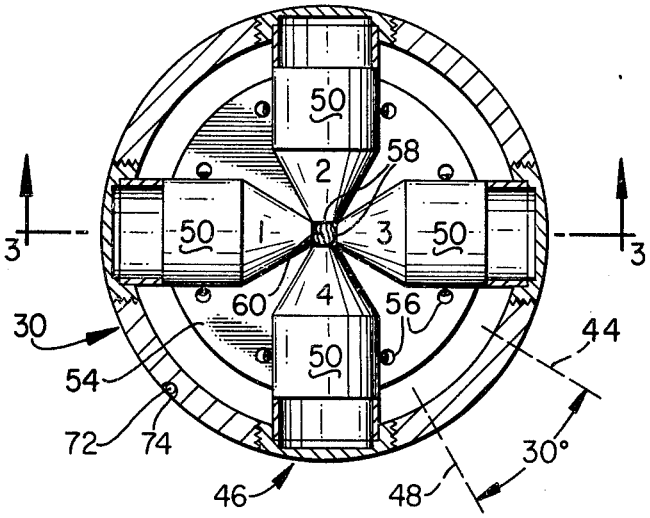
FIG. 2 is an enlarged, part cross-sectional view taken along line 2–2 of FIG. 1.
Figure 3:
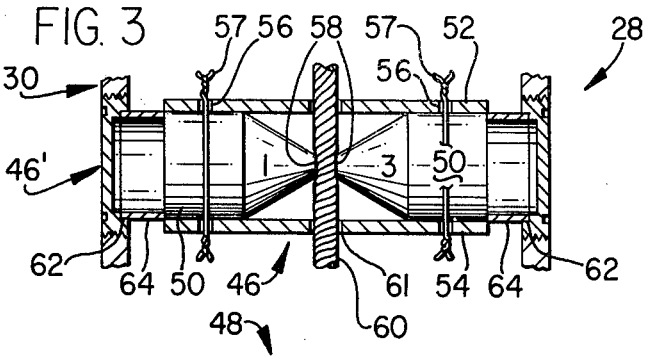
FIG. 3 is an enlarged, fragmented, part cross-sectional view taken along line 3—3 of FIG. 2.

As seen in FIGS. 2 and 3, a cluster 46 of shaped charges 50 are symmetrically arranged in opposition to one another with the shaped end portion thereof being axially aligned with the axial centerline of the circumferentially extending plugs 46', and with each of the plurality of shaped charges being captured in sandwiched relationship between an upper and lower plate members 52 and 54. Appertures 56 are formed vertically through the plate members on either side of a charge, with wire ties 57 extending through the appertures and thereby capturing the shaped charges therewithin in the illustrated manner of the drawings. The shaped charges each have the usual sensitive detonating end which is held compressably forced against a length of prima cord 60. The prima cord extends essentially along the longitudinal axis of the gun housing and is brought through the central axial passageway 61 formed through the center of each of the plate members, thereby forming a means by which all of the charges of a housing can be simultaneously detonated. The shaped end of each of the charges are axially aligned with respect to the rear 62 of the plugs by means of a commercially available cup 64.

As seen in FIG. 1, distance L1 indicates that the clusters are placed on three inch centers. The electrical conductor 65 conducts current from the electrical gun controller C and extends downhole to each of the gun devices. Bands 66 clamp the wire to the tubing string at appropriate spaced intervals along the length thereof. Sub 68 receives the conductor which continues into the firing head 70 so that a plurality of electrical leads at 72 can be extended therefrom. One of the electrical wires enters chamber 30 while the remaining wires continue into and along the spiral groove 74 leading to the underlying gun devices. An electrical lead 76 enters sub 38 for gun 32 while other electrical leads similarly enter the remaining subs for each of the remaining gun devices. Each gun device is similarly provided with a groove 78, ports 44, and mounting assemblies therewithin as in the before described manner.

Figure 4:
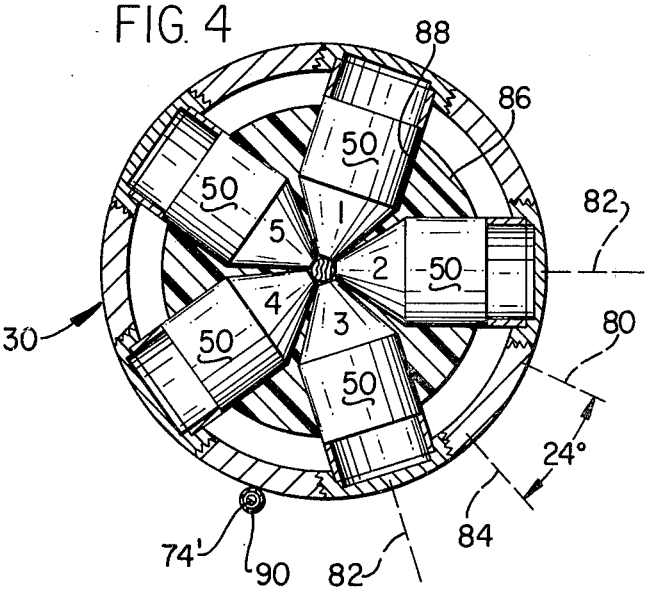
FIG. 4 is similar to FIG. 2 and sets forth an alternate embodiment of this invention.

In FIG. 4 numerals 80, 82 and 84 indicate the orientation of the nearest adjacent shaped charges of three adjacent mounting assemblies. Numeral 82 indicates the shaped charges number 2 and 3 which are radially disposed 72° in diverging directions (360 divided by 5 equals 72) while shaped charge 2, for example, is disposed 24° with respect to the nearest adjacent shaped charge in the adjacent cluster of shaped charges (72 divided by 3).

The mounting assembly 86 is made of plastic or plastic-like material such as hard rubber which can withstand 300° fahrenheit or more for a substantial length of time without undergoing significant degradation in the borehole. The rubber body 86 has a plurality of cavities 88 formed therein for receiving each of the illustrated five shaped charges in captured relationship therewithin.

Electrical conduit 90 is placed externally of the gun and spirals about the outer circumferentially extending surface thereof in a manner similar to the groove 74. The metal conduit protects the electrical conductor 74' from wearing against the casing wall.

Figure 5:
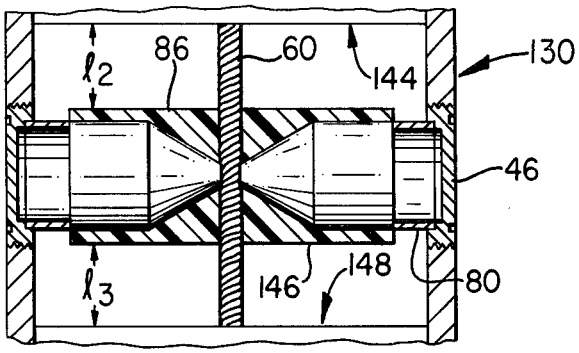
FIG. 5 is similar to FIG. 3 and sets forth an alternate embodiment thereof.

In FIG. 5 the mounting assembly which contains a cluster of shaped charges is seen to underly a similar mounting assembly 144 by a distance L2 and is superimposed above a similar mounting assembly 148 by a distance of L3, with this spacing providing the before mentioned three inch center spacing of the adjacent clusters.

Figure 7:
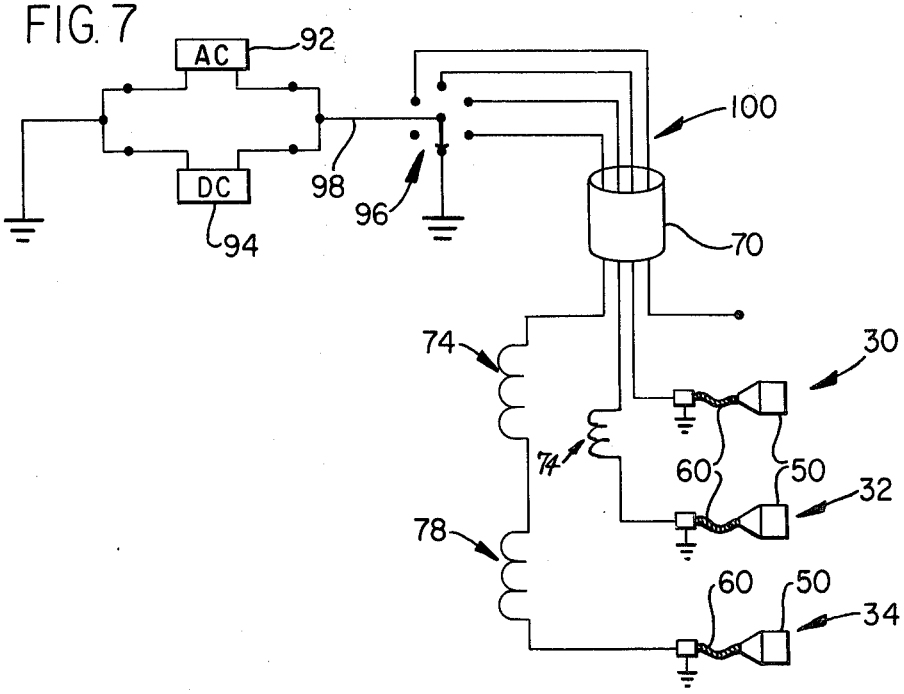
FIG. 7 is a schematical representation of one form of circuitry associated with the present invention.

In FIG. 7 electrical circuitries 92 and 94 provide a controlled source of AC or DC current for the rotory switch assembly 96 by means of conductor 98. The switch assembly is located within the gun firing head. Numeral 100 indicates a cluster of wires such as seen at 72 in FIG. 1. The cluster of wires emerge from the gun head 70 and enter the groove 74 where they spiral about each of the gun devices as each wire terminates at gun devices 30, 32, and 34.

An alternate form of a firing head which can be advantageously used in selectively detonating the guns is found in my issued U.S. Pat. No. 3,717,095.

Figure 6:
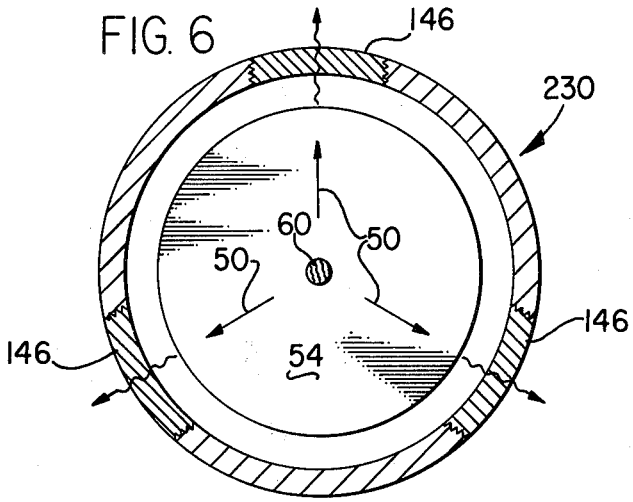
FIG. 6 is a part diagrammatical, part schematical, cross-sectional view of still another embodiment of the present invention.

In the schematical representation seen in FIG. 6, three shaped charges are abuttingly received against the prima cord 60. When the firing head detonates the prima cord 60, the forces of the explosion are simultaneously directed in the directions indicated by the arrows at numeral 50. The resulting explosion provides equal and opposite forces, so that when the shaped charges are in the act of detonating they recoil towards one another while the products of the reaction simultaneously perforate the casing of the wellbore.

Where three shaped charges are used in a cluster, with the spacing L1 of each cluster being on three inch centers, there is made available 12 shots per foot. The three shaped charges are arranged respective to the mounting assembly thereof whereby the charges are orientated to fire in a direction 40° from a corresponding shaped charge located in the next adjacent mounting assembly. When four charges are employed in each cluster, sixteen perforations are made available per foot of casing. In the embodiment of FIG. 4, wherein five shaped charges per cluster are employed, there are twenty perforations per foot of casing realized. The 20 shots per foot is realized in a 9-⅝ inch outside diameter casing.

In carrying out the present invention, all of the shaped charges contained within a gun housing are simultaneously detonated. The individual gun housings preferably are sequentially fired, commencing with the uppermost gun 30 and working downward as guns 32, 34, and 36 are detonated. Alternatively, the reverse sequence can be employed where deemed desirable by firing the lowermost gun 36 first, followed by the remaining guns. This selective firing sequence is made possible because the conductors at 74 are protected from damage.

It has been determined that shaped charges which are presently commercially available for casing guns may be placed in clusters which are vertically spaced apart on three inch centers without suffering from interference from adjacent charges. When the mounting assemblies carrying the clusters are placed closer than the desired three inch centers, the force of the resulting explosion from one cluster to another adjacent cluster interferes with one another and disrupts the symmetry of pattern distribution.

An unexpected advantage gained by simultaneously firing a plurality of clusters of shaped charges wherein each cluster contains a plurality of shaped charges is that equal and opposite forces are achieved throughout the gun which tends to stabilize the entire gun mass so that the precise predetermined perforation pattern desired is attained. A further advantage in the simultaneous firing of the charges arranged in the above described manner is the development of a maximum velocity jet. The presence of 12-20 shaped charges per foot exploding within a unitary closed gun housing thereby expends a much smaller proportion of the explosive energy towards raising the internal pressure of the gun housing. The dominating force of the explosion therefore is expended in forming the perforations rather than in raising the internal pressure of the gun. Still another unexpected advantage in placing a plurality of clusters of shaped charges in a common gun housng in the before disclosed manner is that the casing of the wellbore is subjected to equal and opposite forces resulting from the explosion of the shaped charges thereby eliminating damage to the casing itself as it often occasioned when unequal forces are employed. Furthermore, the gun device is likewise less likely to suffer damage because the symmetrical explosive forces avoid gun contact with the borehole wall.

The present invention enables a symmetrical high density perforating pattern of a predetermined geometrical configuration to be achieved downhole through a casing by making a single trip into the borehole. The casing length containing the perforations can exceed 200 feet where the pay zone requires such an extensive perforated depth.

In operation, the perforating gun device is assembled and run downhole into the borehole until the gun is located adjacent to the formation 14 to be perforated. The packer 20 is set, the vent string 26 moved to the opened position, and the guns detonated by using the controller C connected to the electrical conductor 65. The guns are detonated in any desired sequential order until the entire length of the pay zone is perforated by the accumulated action of the individual guns. During this time, the well can be open flowed to clean up the perforations and to avoid contamination of any sensitive formation with well fluids in accordance with my previously issued U.S. Pat. No. 3,706,344.

What is claimed is:

1. A perforating gun device for use in perforating a casing located downhole in a borehole, said gun device includes a housing, a plurality of firing ports formed in said housing through which a jet from a shaped charge can emerge, a plug in each said firing port;

a plurality of shaped charges forming a cluster, said shaped charges have a forward and rear end with the rear end including means by which the charge can be detonated and the forward end being shaped to cause the discharge to be concentrated into a jet;

a mounting assembly for receiving the shaped charges of said cluster in mounted relationship within said housing, said mounting assembly being of circular configuration and having a diameter less than the diameter of said housing so that the mounting assembly can be telescopingly received within said housing, said mounting assembly includes upper and lower walls spaced from one another with each individual charge of a cluster being removably captured therebetween and orientated to fire radially away from a central axis, a detonator means located at said central axis, the rear of each shaped charge of a cluster being in contact with said detonator, and the forward end of each said charge being directed away from said detonator;

a circular spacer interposed between said forward end of said shaped charge and said firing port so that said mounting assembly is supported in aligned relationship within said housing with a firing port being aligned with each said charge of a cluster such that when the detonator explodes the shaped charges, the jet therefrom exits axially through said port;

each said mounting assembly being spaced apart from one another within said housing, means connecting each detonator for simultaneously detonating all of the shaped charges in a gun housing.

2. The perforating gun device of claim 1 wherein there is further included a gun firing head, said detonator comprises a length of prima cord which extends longitudinally through the housing and axially through the center of each said mounting assembly, each said charge of a cluster having the rear end thereof placed in abutting engagement with said prima cord, and means included in said gun firing head for exploding said prima cord.

3. The perforating gun device of claim 1 wherein there is included a plurality of gun housings, sub means series connecting said housings together such that the housings form a string of individual gun housings isolated from one another, thereby enabling a formation of any thickness to be perforated by the cumulative action of the series connected gun housings.

4. The perforating gun device of claim 1 wherein there are four shaped charges in a cluster, each shaped charge being positioned 90° circumferentially from an adjacent charge, each cluster being spaced along three inch centers respective to one another along the length of the gun; the shaped charge of one cluster being radially spaced 30° from the nearest shaped charge of an adjacent cluster.

5. The perforating gun of claim 1 wherein there is included a plurality of gun housings, means series connecting said housings together such that the housings form a string of individual gun housings thereby enabling a formation of any thickness to be perforated by the gun device;

each shaped charge of one cluster being spaced radially from the nearest shaped charge of an adjacent cluster by progressively and sequentially axially rotating each said mounting assembly along the length of the gun housing.

6. The perforating gun of claim 1 wherein there is included a plurality of gun housings, means series connecting said housings together such that the housings form a string of individual gun housings thereby enabling a formation of any thickness to be perforated by the gun devices;

and further including means by which any one of said plurality of gun housings is selectively discharged so that the gun string can be repositioned respective to the formation to be perforated following the detonation of each gun housing.

7. A perforating gun device having a main housing, a plurality of shaped charges forming a cluster of charges, a plurality of said cluster of charges; a port formed in said main housing for each shaped charge;

a plurality of mounting assemblies, a cluster of charges received within each of said mounting assemblies, each mounting assembly having an upper and lower circular wall which receives the charges of a cluster therebetween, means by which the upper and lower walls are affixed to one another and to each of the charges of a cluster such that all of the shaped charges of a cluster are captured in mounted relationship therewithin with the charges being circumferentially spaced apart and disposed in a horizontal plane which lies normal to the longitudinal centerline of the housing;

each said charge of a cluster being orientated to penetrate in a direction radially away from the longitudinal centerline of the housing;

a cylindrical spacer axially aligned with and interconnecting each charge with each port such that said mounting assemblies are telescopingly received in spaced relationship within said housing such that all of the charges thereof are circumferentialy spaced about the axial centerline of the main housing;

a detonation means by which all of the charges in a housing are simultaneously detonated, each shaped charge having a detonator end and a shaped end, the detonator end of each shaped charge of a cluster being placed contingent to said detonator means;

the adjacent mounting assemblies being orientated within the housing to radially misalign any one shaped charge of a cluster respective to the nearest charge of an adjacent cluster;

and means by which the detonator means can be exploded.

8. The perforating gun device of claim 7 wherein there is further included a gun firing head, said detonator is a length of prima cord which extends longitudinally through the housing and axially through the center of the mounting assembly, each said charge of a cluster having the rear end thereof placed in abutting engagement with said prima cord, and means responsive to said gun firing head for exploding said prima cord.

9. The perforating gun device of claim 7 wherein there is included a plurality of gun housings, means series connecting said housings together such that the housings form a string of individual gun housings thereby enabling a formation of any thickness to be perforated by the gun device.

10. The perforating gun device of claim 7 wherein there are four shaped charges in a cluster, each shaped charge being positioned 90° circumferentially from an adjacent charge, each cluster being spaced at three inch centers respective to one another along the length of the gun, the shaped charge of one cluster being radially spaced 30° from the nearest shaped charge of an adjacent cluster.

11. The perforating gun device of claim 7 wherein there is included a plurality of gun housings, means series connecting said housings together such that the housings form a string of individual gun housings thereby enabling a formation of any thickness to be perforated by the gun device;

each shaped charge of one cluster being spaced radially from the nearest shaped charge of an adjacent cluster by progressively axially rotating each said mounting assembly sequentially along the length of the gun housing.

* * * * *

UNITED STATES PATENT OFFICE

CERTIFICATE OF CORRECTION

Patent No. 4,140,188 Dated February 20, 1979

Inventor(s) ROY R. VANN

It is certified that error appears in the above-identified patent and that said Letters Patent are hereby corrected as shown below:

Of the cover page of the Letters Patent: [75] correct the inventor's address to read -- Houston, Texas -- instead of "Odessa, Texas".

Of the cover page of the Letters Patent: [73] correct the spelling of Assignee's name to read --Peabody Vann-- instead of "Peadby Vann";

Column 2, line 40, correct the spelling of "downhole";

Column 5, line 12, correct the spelling of "dominant";

Column 5, line 20, substitute --is-- for "it";

Column 7, line 17, correct the spelling of "circumferentially".

Signed and Sealed this

Thirty-first Day of July 1979

[SEAL]

Attest:

Attesting Officer

LUTRELLE F. PARKER

Acting Commissioner of Patents and Trademarks